US007278391B1

(12) United States Patent
Wong et al.

(10) Patent No.: US 7,278,391 B1
(45) Date of Patent: Oct. 9, 2007

(54) CYLINDER DEACTIVATION TORQUE LIMIT FOR NOISE, VIBRATION, AND HARSHNESS

(75) Inventors: Kevin C. Wong, Ann Arbor, MI (US); Alfred E. Spitza, Jr., Brighton, MI (US); William R. Venner, III, Milford, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/530,688

(22) Filed: Sep. 11, 2006

(51) Int. Cl.
*F02B 75/06* (2006.01)
*F02D 13/06* (2006.01)

(52) U.S. Cl. ..... 123/198 F; 123/192.1

(58) Field of Classification Search ..... 123/198 F, 123/192.1
See application file for complete search history.

(56) References Cited

U.S. PATENT DOCUMENTS 4,245,471 A * 1/1981 Sugasawa et al. ..... 123/198 F
4,489,685 A * 12/1984 Kinoshita et al. ..... 123/198 F
5,408,974 A * 4/1995 Lipinski et al. ..... 123/198 F
5,540,633 A * 7/1996 Yamanaka et al. ..... 123/198 F
5,568,795 A * 10/1996 Robichaux et al. ..... 123/198 F
7,044,101 B1 * 5/2006 Duty et al. ..... 123/198 F
2006/0107919 A1 * 5/2006 Nishi et al. ..... 123/198 F

* cited by examiner

*Primary Examiner*—Noah P. Kamen

(57) ABSTRACT

An engine control system for controlling the engine to transition between an activated mode where all cylinders are active and a deactivated mode where less than all cylinders are active is provided. The system includes: a noise vibration and harshness (NVH) limit module that determines a noise, vibration, and harshness (NVH) torque limit based on the engine speed and the vehicle speed; and a mode transition module that enables the engine to transition between the deactivated mode and the activated mode while limiting noise, vibration, and harshness based on the NVH torque limit and a requested torque.

10 Claims, 4 Drawing Sheets

CYLINDER DEACTIVATION TORQUE LIMIT FOR NOISE, VIBRATION, AND HARSHNESS

FIELD

The present disclosure relates to methods and systems for displacement on demand internal combustion engines.

BACKGROUND

The statements in this section merely provide background information related to the present disclosure and may not constitute prior art.

Some internal combustion engines include engine control systems that deactivate one or more cylinders during operation. The deactivation typically occurs under low load situations. For example, an eight cylinder engine can be operated using four cylinders to improve fuel economy by reducing pumping losses. This process is generally referred to as displacement on demand or DOD. Operation using all of the engine cylinders is referred to as an activated mode. A deactivated mode refers to operation using less than all of the cylinders of the engine (one or more cylinders not active).

Conventional methods of controlling the engine to transition between the activated mode and the deactivated mode are based on engine vacuum. Some methods include an engine vacuum hysteresis pair to prevent toggling between the activated and deactivated modes. These methods neglect engine torque and have a negative impact on fuel economy during low engine torque conditions. Likewise, the methods tend to have a negative impact on noise, vibration, and harshness during high engine torque conditions.

SUMMARY

Accordingly, an engine control system for controlling the engine to transition between an activated mode where all cylinders are active and a deactivated mode where less than all cylinders are active is provided. The system includes: a noise vibration and harshness (NVH) limit module that determines a noise, vibration, and harshness (NVH) torque limit based on the engine speed and the vehicle speed; and a mode transition module that enables the engine to transition between the deactivated mode and the activated mode while limiting noise, vibration, and harshness based on the NVH torque limit and a requested torque.

In other features, a method of controlling an internal combustion engine to transition between an activated mode where all cylinders are active and a deactivated mode where less than all cylinders are active is provided. The method includes: determining a noise, vibration, and harshness (NVH) torque limit based on engine speed and vehicle speed; and controlling the engine to transition from the deactivated mode to the activated mode while limiting NVH if a requested torque is greater than the NVH torque limit.

In still other features, a method of controlling an internal combustion engine to transition between an activated mode where all cylinders are active and a deactivated mode where less than all cylinders are active is provided. The method includes: determining a noise, vibration, and harshness (NVH) torque limit based on engine speed and vehicle speed; and controlling the engine to transition from the activated mode to the deactivated mode while limiting NVH if a requested torque is less than the NVH torque limit minus a hysteresis.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
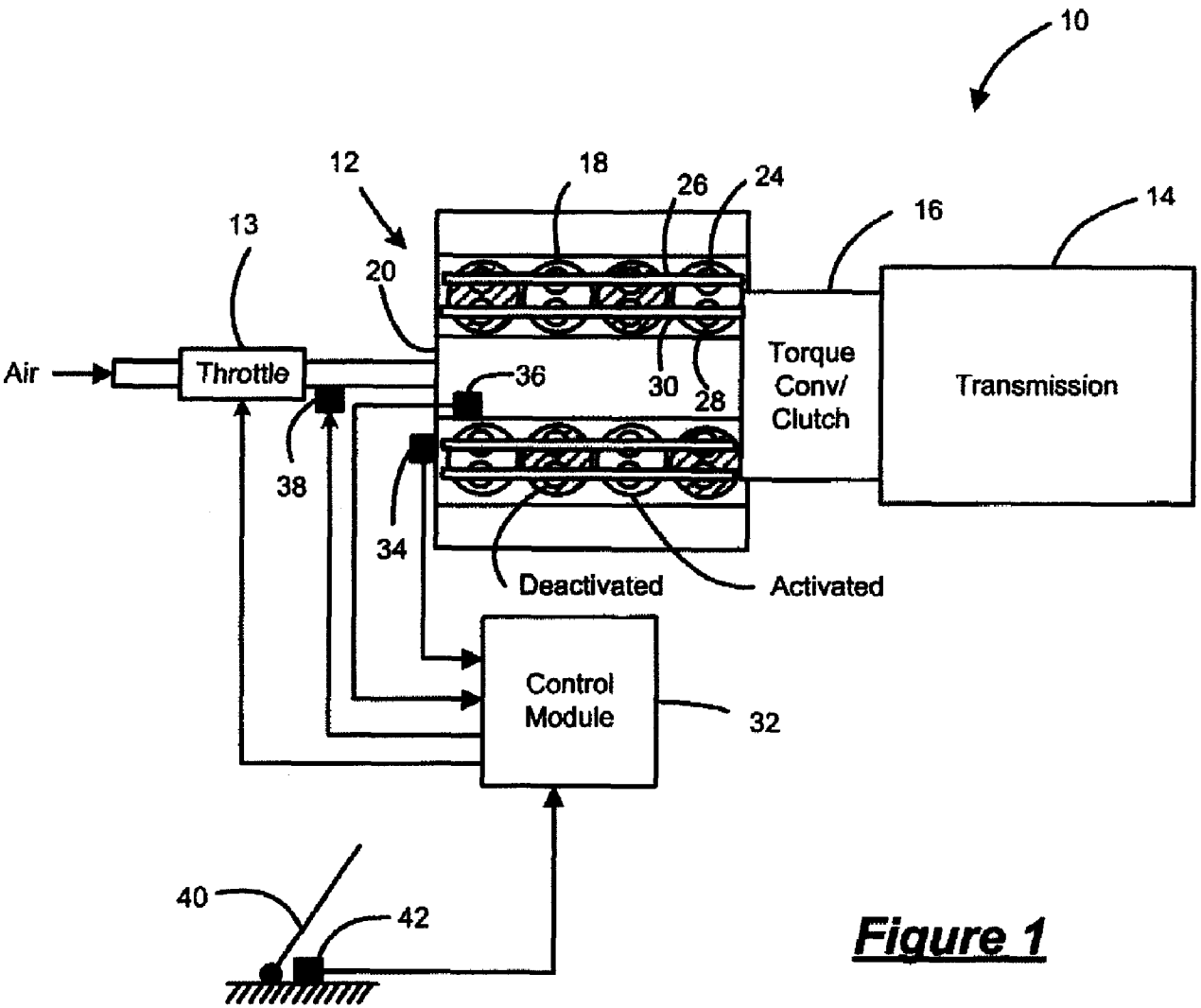
FIG. 1 is a functional block diagram of a vehicle including a displacement on demand internal combustion engine.

The following description is merely exemplary in nature and is not intended to limit the present disclosure, application, or uses. It should be understood that throughout the drawings, corresponding reference numerals indicate like or corresponding parts and features. As used herein, activated refers to operation using all of the engine cylinders. Deactivated refers to operation using less than all of the cylinders of the engine (one or more cylinders not active). As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, a vehicle 10 includes an engine 12 that drives a transmission 14. The transmission 14 is either an automatic or a manual transmission that is driven by the engine 12 through a corresponding torque converter or clutch 16. Air flows into the engine 12 through a throttle 13. The engine 12 includes N cylinders 18. One or more of the cylinders 18 are selectively deactivated during engine operation. Although FIG. 1 depicts eight cylinders (N=8), it is appreciated that the engine 12 may include additional or fewer cylinders 18. For example, engines having 4, 5, 6, 8, 10, 12 and 16 cylinders are contemplated. Air flows into the engine 12 through an intake manifold 20 and is combusted with fuel in the cylinders 18.

Intake valves 24 of the engine selectively open and close to enable the air to enter the cylinders 18 through inlet ports. A position of the intake valves is regulated by an intake camshaft 26. Fuel injectors (not shown) simultaneously injects fuel into the cylinders 18. The fuel injectors are controlled to provide a desired air-to-fuel (A/F) ratio within the cylinder 18. Pistons (not shown) compress the A/F mixture within the cylinders 18. The compression of the hot air ignites the fuel in the cylinders 18, which drives the pistons. The pistons, in turn, drive a crankshaft (not shown) to produce drive torque. Combustion exhaust within the cylinders 18 is forced out exhaust ports when exhaust valves 28 are in an open position. A position of the exhaust valves is regulated by an exhaust camshaft 30. Although single intake and exhaust valves 24 and 28 are illustrated per cylinder 18, it can be appreciated that the engine 12 can include multiple intake and exhaust valves 24 and 28 per cylinder 18.

A control module 32 communicates with the engine 12 and various inputs and sensors as discussed herein. An engine speed sensor 34 generates a signal based on engine speed. An intake manifold absolute pressure (MAP) sensor 36 generates a signal based on a pressure of the intake manifold 20. A mass airflow (MAF) sensor 38 generates a signal based on the mass of air flowing into the engine 12. A vehicle speed sensor (not shown) is located along the driveline (not shown) of the vehicle and generates a vehicle speed signal.

A vehicle operator manipulates an accelerator pedal 40 to regulate the throttle 13. More particularly, a pedal position sensor 42 generates a pedal position signal that is communicated to the control module 32. The control module 32 calculates a driver requested torque from the pedal position signal. The control module 32 determines an engine torque from the various airflow, RPM, load, and temperature sensors signals according to conventional methods. The control module 32 generates a throttle control signal based on the requested torque and the engine torque. A throttle actuator (not shown) adjusts the throttle 13 based on the throttle control signal to regulate airflow into the engine 12

When light engine load occurs, the control module 32 transitions the engine 12 to the deactivated mode. In an exemplary embodiment, N/2 cylinders 18 are deactivated. Fuel, air, and spark are cut off to the deactivated cylinders. The inlet and exhaust ports of the deactivated cylinders 18 are closed to reduce pumping losses. A lost motion device may act to decouple the intake and exhaust valves 24 and 28 from their respective camshafts 26 and 30 to disable operation.

Figure 2:
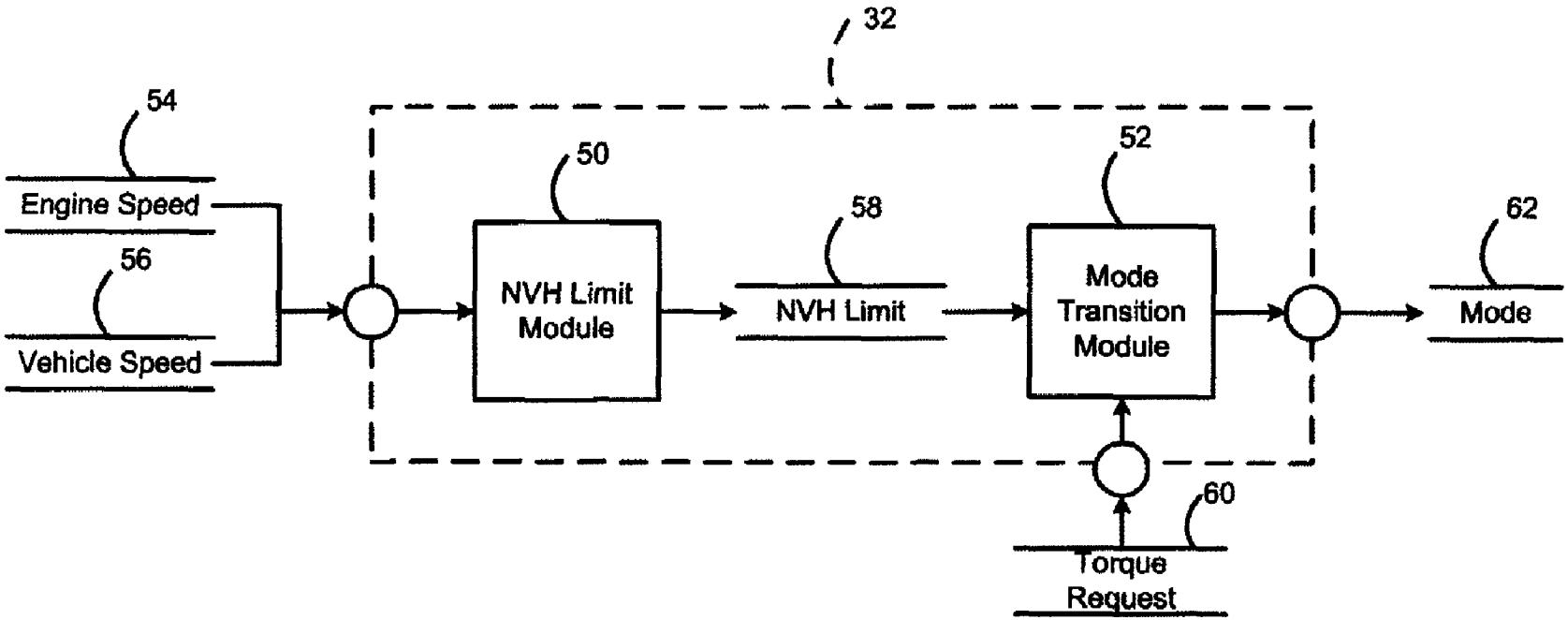
FIG. 2 is a dataflow diagram illustrating a cylinder deactivation system.

Referring now to FIG. 2, the present disclosure provides a control method and system that governs the transitions between the activated mode and the deactivated mode based on a noise, vibration, and harshness (NVH) torque limit. The NVH torque limit is determined as the maximum amount of torque that can be produced in the deactivated mode without generating excessive noise, vibration, and harshness (NVH). A dataflow diagram illustrates various embodiments of the cylinder deactivation system that may be embedded within the control module 32. Various embodiments of cylinder deactivation systems according to the present disclosure may include any number of sub-modules embedded within the control module 32. The sub-modules shown may be combined and/or further partitioned to similarly govern the transitions between the activated mode and the deactivated mode.

In various embodiments, the control module 32 of FIG. 2 includes an NVH limit module 50 and a mode transition module 52. The NVH limit module 50 receives as input engine speed 54 and vehicle speed 56. As can be appreciated, the inputs to the system may be sensed from the vehicle 10, received from other control modules (not shown) within the vehicle 10, or determined from other sub-modules within the control module 32. The NVH limit module 50 determines a NVH torque limit 58 based on the engine speed 54 and vehicle speed 56. The mode transition module 52 receives as input the NVH torque limit 58 and a torque request 60. The mode transition module 52 selects a current mode 62 to be either the activated mode or the deactivated mode based on a comparison of the NVH torque limit 58 and the torque request 60.

Figure 3:
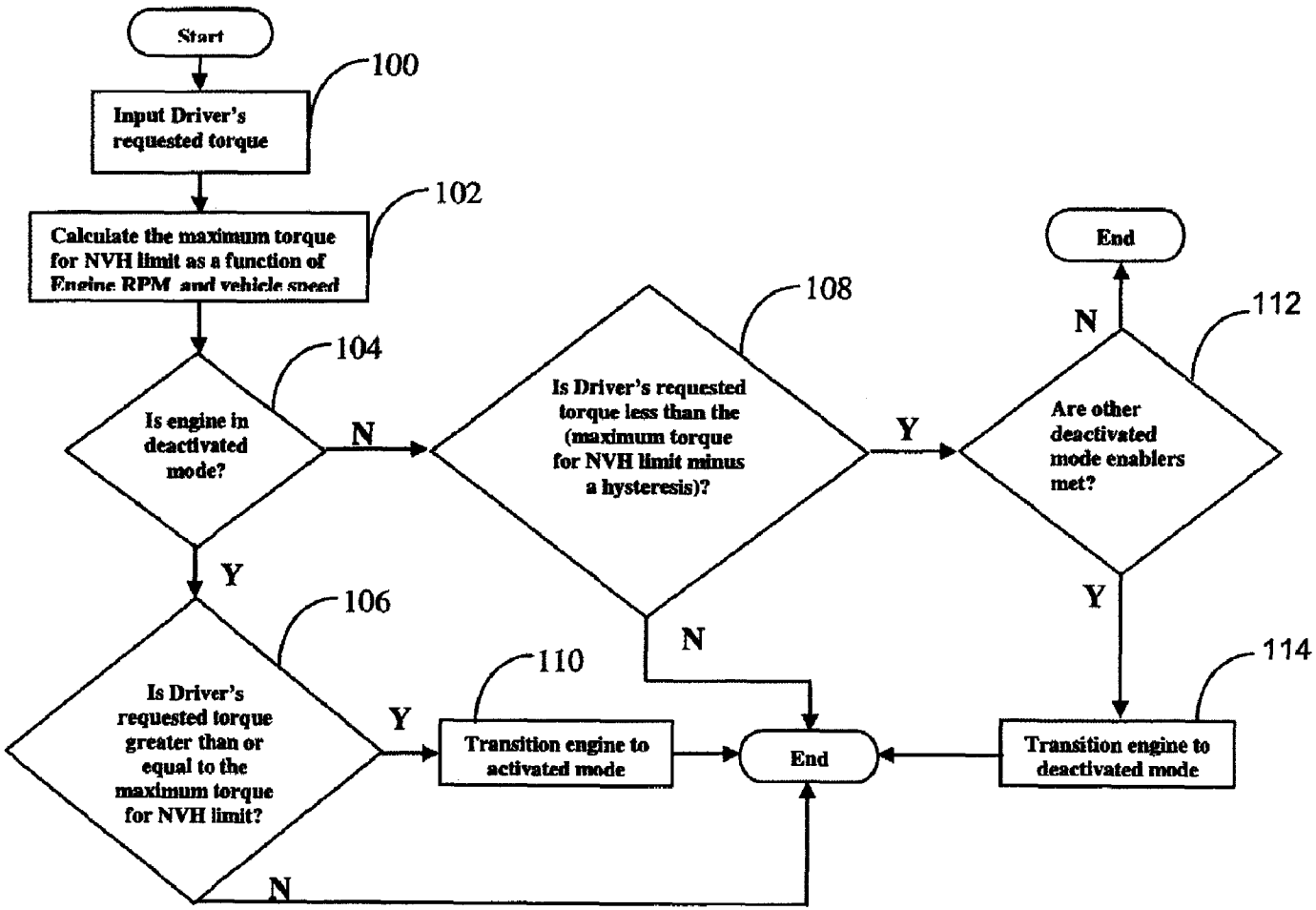
FIG. 3 is a flowchart illustrating a method of controlling cylinder deactivation based on a torque limit for noise, vibration, and harshness (NVH).

Referring now to FIG. 3, a flowchart illustrates a method of controlling cylinder deactivation based on torque limits for NVH according to the present disclosure. The method shown may be continually run while the vehicle ignition is on. In an exemplary embodiment, the method is run every one second. In FIG. 3, a driver's requested torque is determined from the throttle position at 100. A NVH torque value for NVH is determined based on engine speed and vehicle speed at 102. In various embodiments, the maximum torque limit may be interpolated from a two dimensional table with engine speed and vehicle speed as the indices. If the engine is in the deactivated mode at 104, control evaluates the driver requested torque at 106. If the driver requested torque is greater than or equal to the NVH torque limit for NVH at 106, control transitions the engine to the activated mode at 110. Otherwise, if the engine is not in the activated mode at 104, control evaluates the driver's requested torque at 108. If the driver's requested torque is less than the NVH torque limit for NVH minus a hysteresis at 108, control evaluates other deactivated mode enable conditions at 112. If other engine deactivation mode conditions, including but not limited to, adequate oil pressure, engine speed, and transmission gear are met at 112, control transitions the engine to the deactivated mode at 114.

Figure 4:
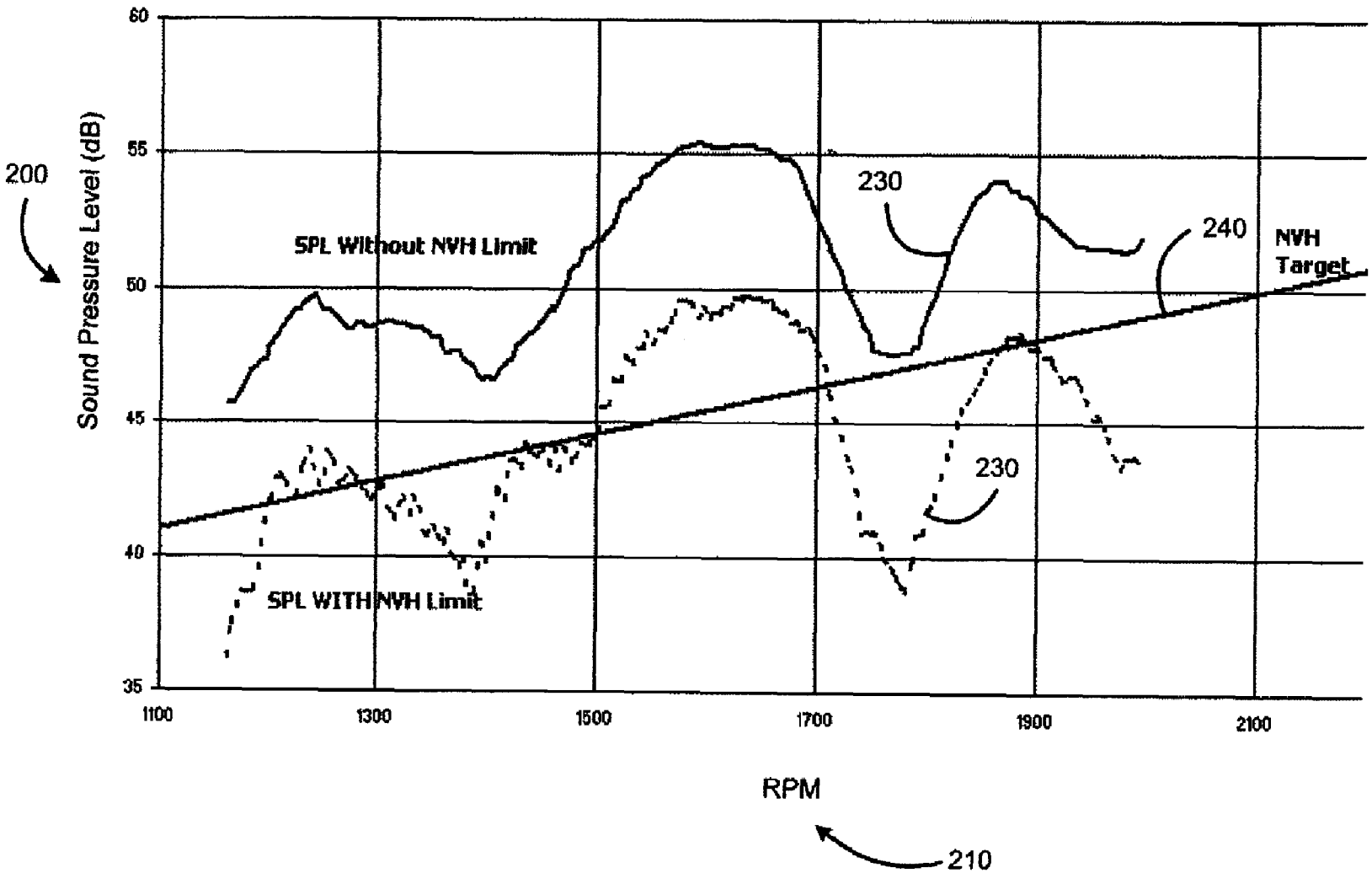
FIG. 4 is a graph illustrating noise data during cylinder deactivation events with NVH torque limit control and without the NVH torque limit control.

Referring now to FIG. 4, a graph illustrates noise data during cylinder deactivation operation with the NVH torque limit control method activated and without the NVH torque limit control activated. Sound pressure levels in decibels (dB) are shown along the y-axis at 200. Engine speed in RPM is shown along the x-axis at 210. Sound pressure level data obtained without the NVH torque limit method activated is shown at 220. Sound pressure level data obtained with the NVE torque limit method activated is shown at 230. The target NVH level is shown at 240. It can easily be seen that the NVH limit is noticeable improvement over the unlimited operation with respect to the target NVH.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An engine control system for controlling the engine to transition between an activated mode where all cylinders are active and a deactivated mode where less than all cylinders are active, comprising:

a noise vibration and harshness (NVH) limit module that determines a noise, vibration, and harshness (NVH) torque limit based on the engine speed and the vehicle speed; and a mode transition module that enables the engine to transition from the activated mode to the deactivated mode while limiting noise, vibration, and harshness based on a comparison of the NVH torque limit minus a hysteresis and a requested torque.

2. The system of claim 1 wherein the mode transition module commands the transition from the deactivated mode to the activated mode if the requested torque is greater than the NVH torque limit.

3. The system of claim 1 wherein the mode transition module commands the transition from the deactivated mode to the activated mode if the requested torque is equal to the NVH torque limit.

4. The system of claim 3 wherein the mode transition module enables the transition from the activated mode to the deactivated mode if engine deactivation enable conditions are met.

5. The system of claim 1 wherein the mode transition module determines the requested torque based on an accelerator pedal position.

6. The method of claim 1 wherein the NVH limit module determines the NVH torque limit based on an interpolation of values stored in a two dimensional table defined by indices of engine speed and vehicle speed.

7. A method of controlling an internal combustion engine to transition between an activated mode where all cylinders are active and a deactivated mode where less than all cylinders are active, comprising:

determining a noise, vibration, and harshness (NVH) torque limit based on engine speed and vehicle speed; and controlling the engine to transition from the activated mode to the deactivated mode while limiting NVH if a requested torque is less than the NVH torque limit minus a hysteresis.

8. The method of claim 7 wherein the controlling comprises controlling the engine to transition from the activated mode to the deactivated mode if the requested torque is less than the NVH torque limit minus a hysteresis and if engine deactivation enable conditions are met.

9. The method of claim 7 further comprising determining the requested torque from an accelerator pedal position.

10. The method of claim 7 wherein the determining comprises determining the NVH torque limit based on interpolating values from a two dimensional table defined by indices of engine speed and vehicle speed.

* * * * *